United States Patent [19]

Wuyten et al.

[11] Patent Number: 4,860,918

[45] Date of Patent: Aug. 29, 1989

[54] SYSTEM FOR CONSTRUCTING AIR CONDITIONING CABINETS AND METHOD FOR CONSTRUCTING SAME

[75] Inventors: Johannes M. Wuyten; Adriaan L. Daelmans, both of Waalwijk, Netherlands

[73] Assignee: Holland Heating BV, Netherlands

[21] Appl. No.: 945,863

[22] Filed: Dec. 23, 1986

[30] Foreign Application Priority Data

Jan. 2, 1986 [NL] Netherlands ..... 8600002
Jul. 7, 1986 [NL] Netherlands ..... 8601764

[51] Int. Cl.[4] ..... B65J 1/00

[52] U.S. Cl. ..... 220/84; 220/1.5; 220/4 F

[58] Field of Search ..... 220/84, 80, 76, 4 F, 220/1.5, 469

[56] References Cited

U.S. PATENT DOCUMENTS

| | | | |
|---|---|---|---|
| 778,696 | 12/1904 | McKenzie | 220/469 |
| 2,167,525 | 7/1939 | Rosendale | 220/84 X |
| 2,205,826 | 6/1940 | Small | 220/84 |
| 2,364,083 | 12/1944 | Lindsay | 220/84 X |
| 3,294,276 | 12/1966 | Kemp et al. | 220/84 X |
| 3,561,634 | 2/1971 | Meldrum | 220/1.5 |
| 4,173,379 | 11/1979 | vander Heiden et al. | 220/4 FX |

*Primary Examiner*—Steven M. Pollard
*Attorney, Agent, or Firm*—John P. Snyder

[57] ABSTRACT

This construction system provides a single and a double walled form without it being necessary during the fitting of the wall panels to crawl inside the frame. This construction system is therefor characterized in that adjoining outer panels are provided with edges, profiled and gripping into each other such that said adjoining outer panels can be arranged from outside said frame and that said edges grippping into each other thereby form a projection that can be attached to an inner panel which is present if required.

15 Claims, 10 Drawing Sheets

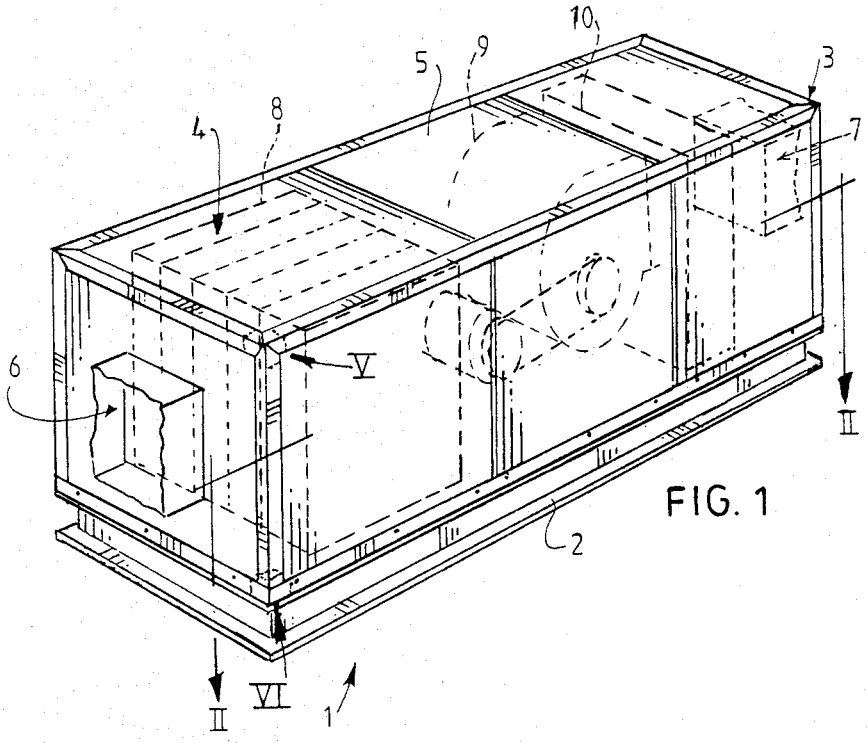
FIG. 1
FIG. 2
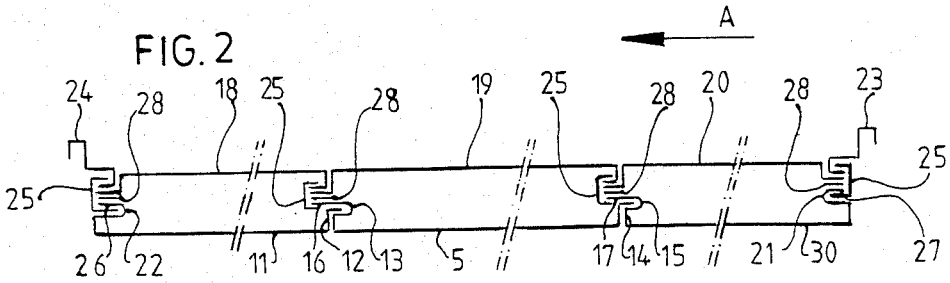
FIG. 3
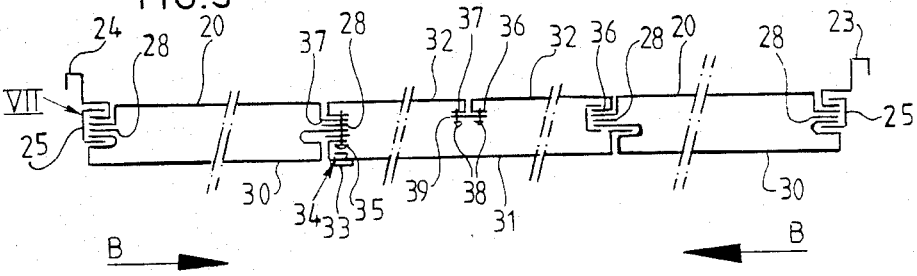

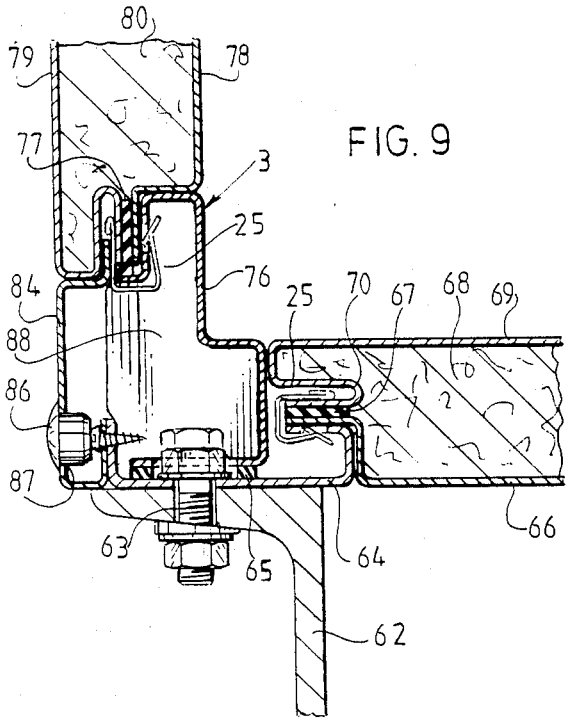
FIG. 9
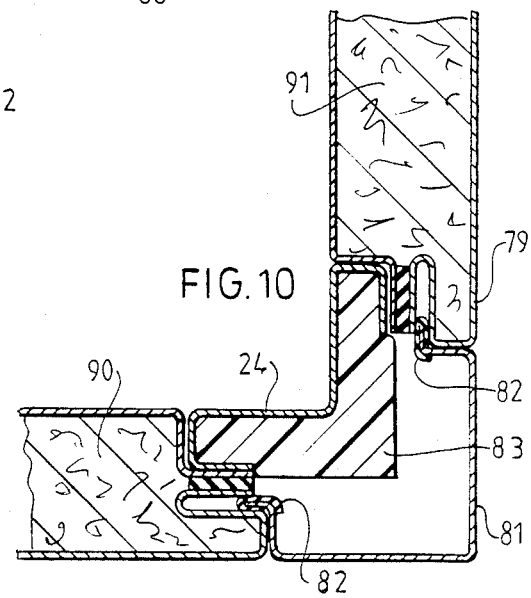
FIG. 10
FIG. 11
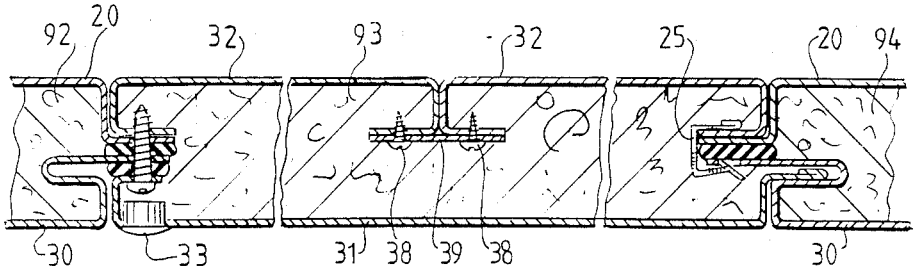

SYSTEM FOR CONSTRUCTING AIR CONDITIONING CABINETS AND METHOD FOR CONSTRUCTING SAME

The invention relates to a system for constructing air conditioning cabinets according to the preamble of claim 1.

Such a construction system is known. the outer panels are hereby attached to one another and to the frame, whereby it is necessary to crawl inside the frame to do this, which, certainly in the case of small air conditioning cabinets, is awkward. Such a construction system is often suitable for example for making an air conditioning cabinet in double walled form, and for making one in single walled form another construction system has then to be applied.

The invention has for its object to provide a construction system whereby the air conditioning cabinets can take a single as well as double walled form without it being necessary during the fitting of the wall panels to crawl inside the already constructed frame.

This purpose is achieved with the construction system according to the characteristic of claim 1.

With the construction system according to the invention inner panels can be either fitted or omitted, resulting in either a double walled or single walled air conditioning cabinet.

With modern anti-ruse treatments for metal, such as zinc plating and cataphoresis treatments it is advantageous if it is no longer necessary to drill or screw into the panels and rib profiles of the air conditioning cabinet, as the protective layers are hereby removed again locally and the metal will be corroded in the course of time. In a preferred embodiment of the construction system according to the invention virtually all connections can be carried out with clamps (claim 12).

In addition, with a preferred embodiment of the construction system according to the invention an air conditioning cabinet can be constructed that is cold bridge free, also in the frame, by locating strips of insulating material between all inner and outer panels (claim 16), which is also possible in a simple manner with the wall panels to be attached to the rib profiles.

Sealing the gaps between the wall panels and the rib profiles with sealing compound is therefore no longer necessary.

The invention also provides a method for constructing an air conditioning cabinet, whereby air conditioning apparatus is placed in a frame built up from the ground and the wall panels are subsequently arranged against the frame from outside without it being necessary to tilt the constructed frame in the meantime.

Figure 4A:
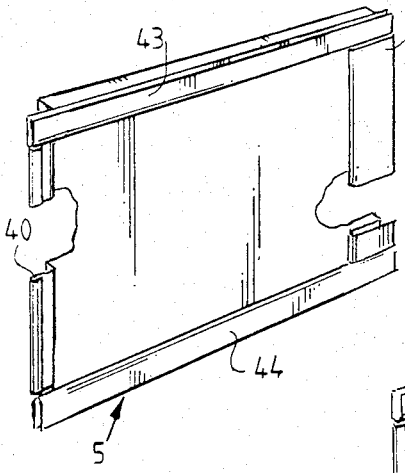
Figure 4B:
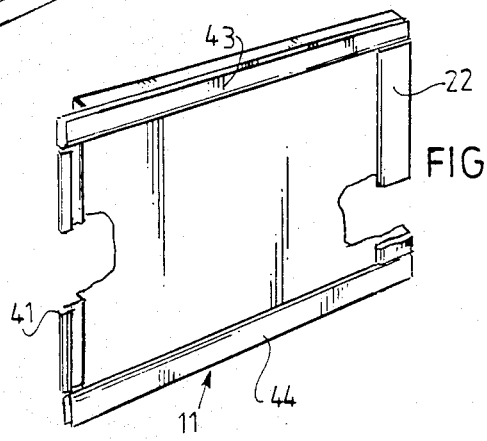
Figure 4C:
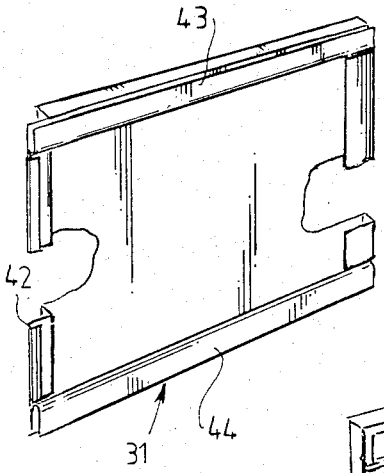
Figure 4D:
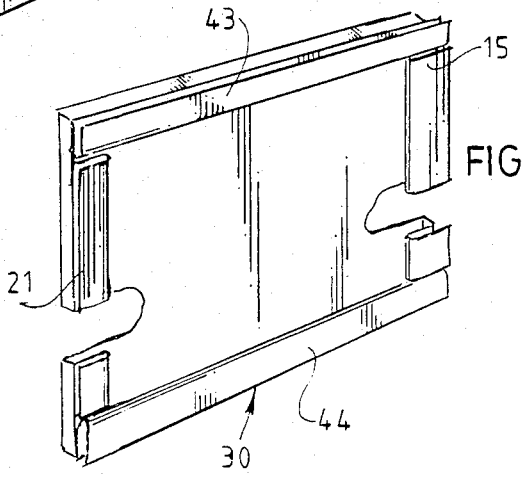
Figure 4E:
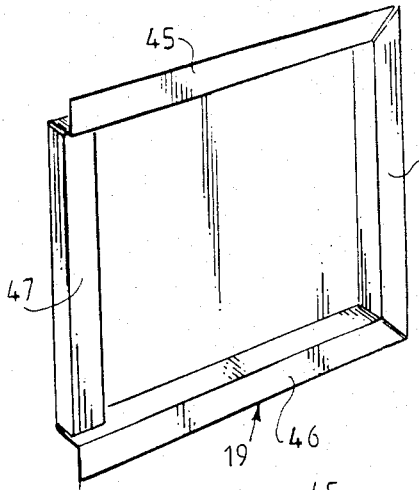
Figure 4F:
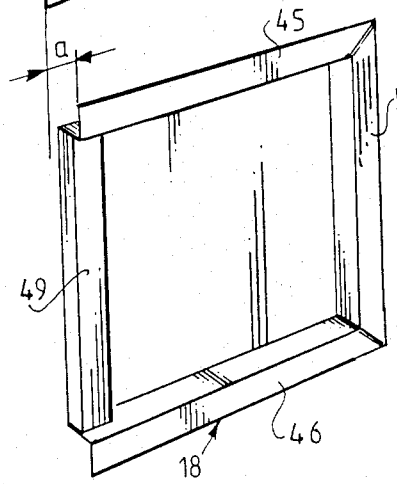
Figure 4G:
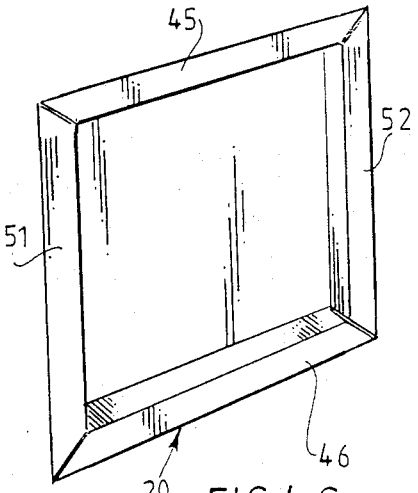
Figure 4H:
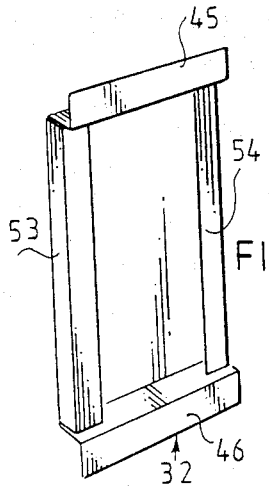
Figure 5:
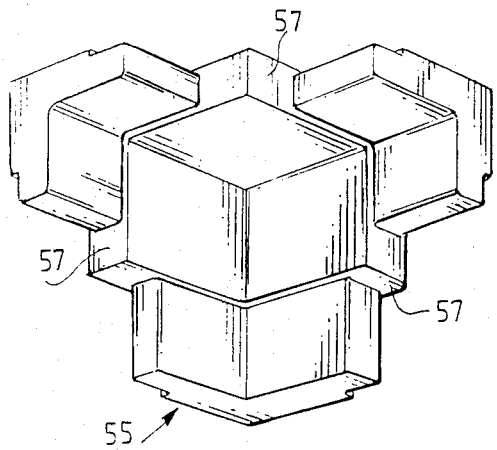
Figure 6:
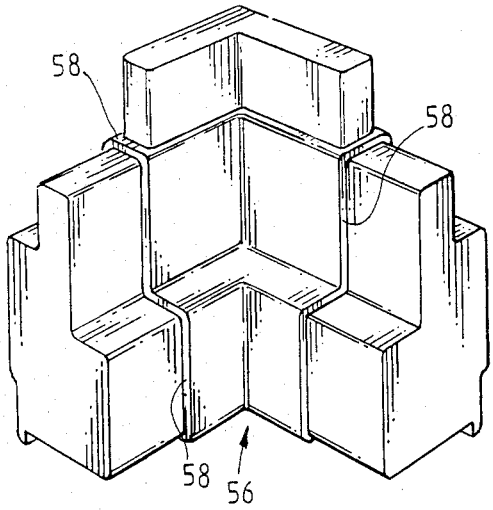
Figure 7:
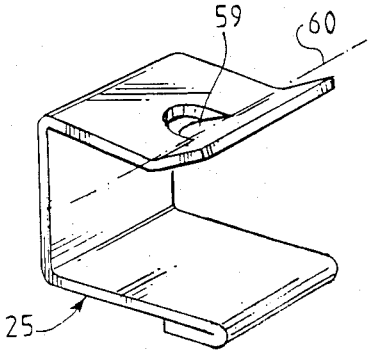
Figure 8A:
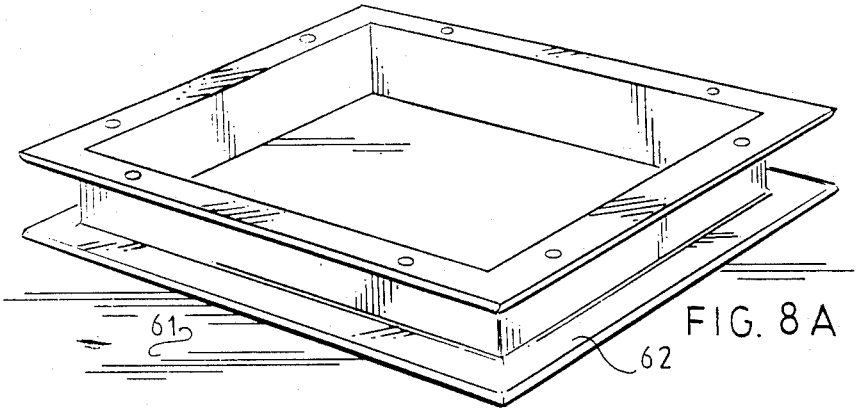
Figure 8B:
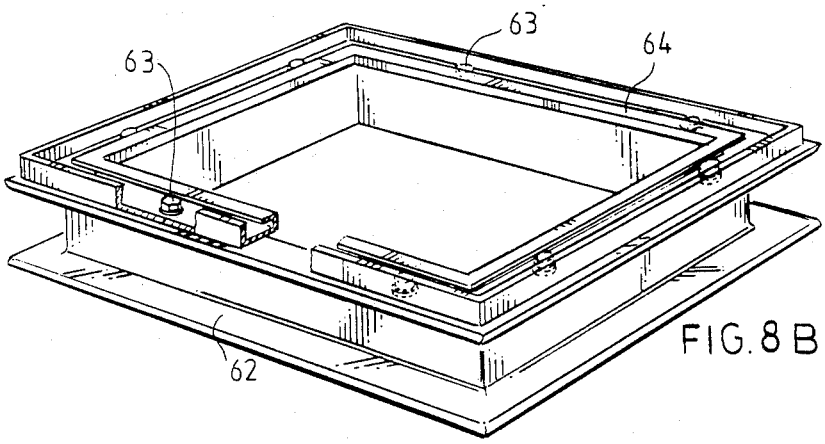
Figure 8C:
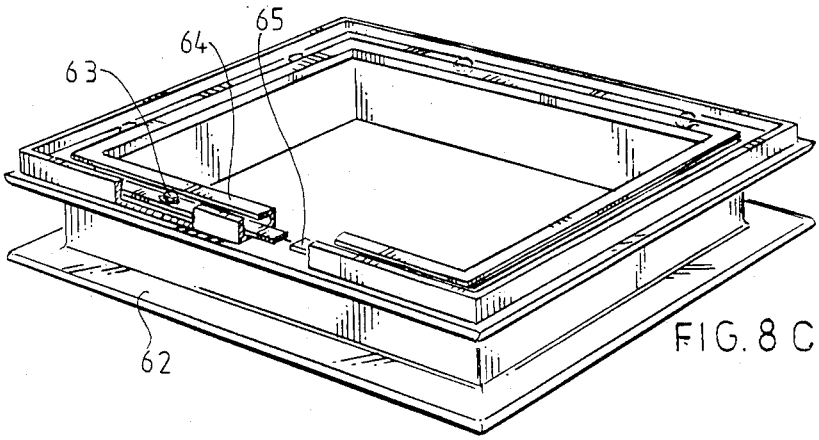
Figure 8D:
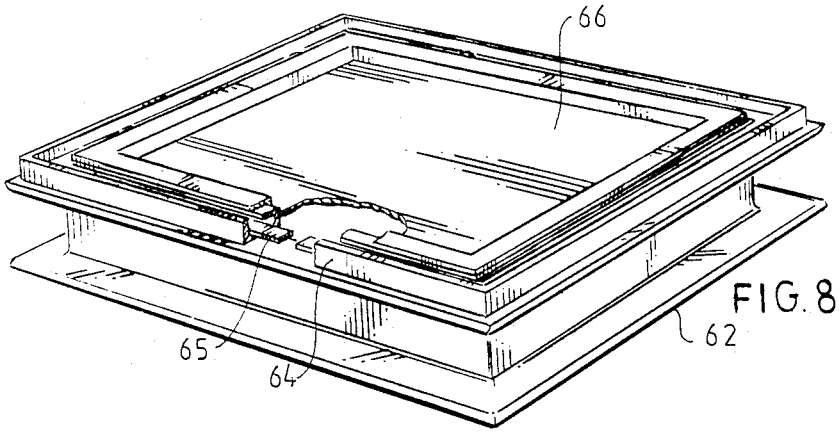
Figure 8E:
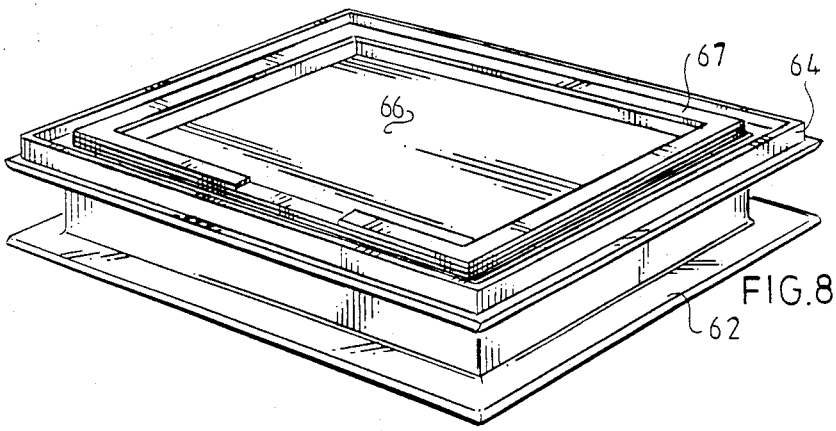
Figure 8F:
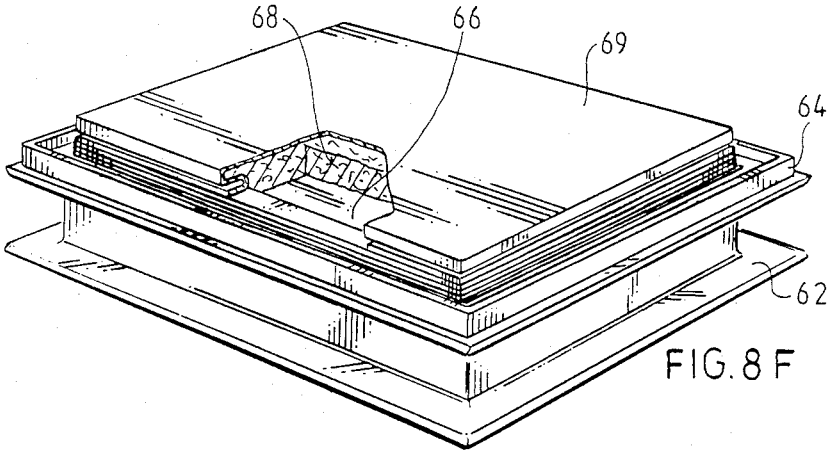
Figure 8G:
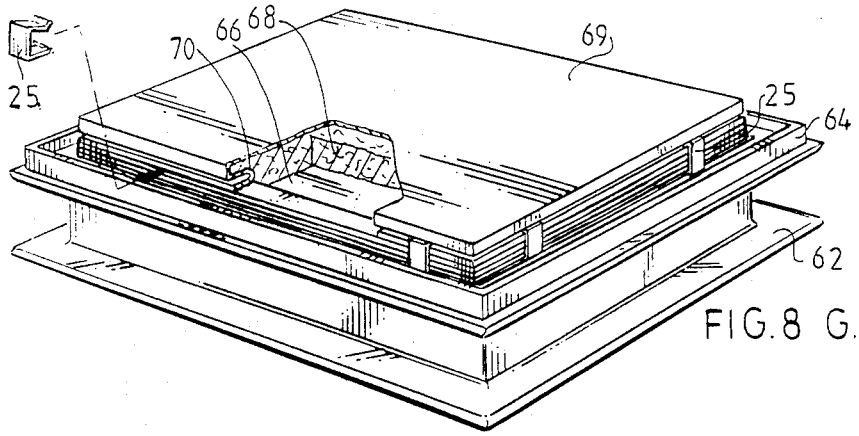
Figure 8H:
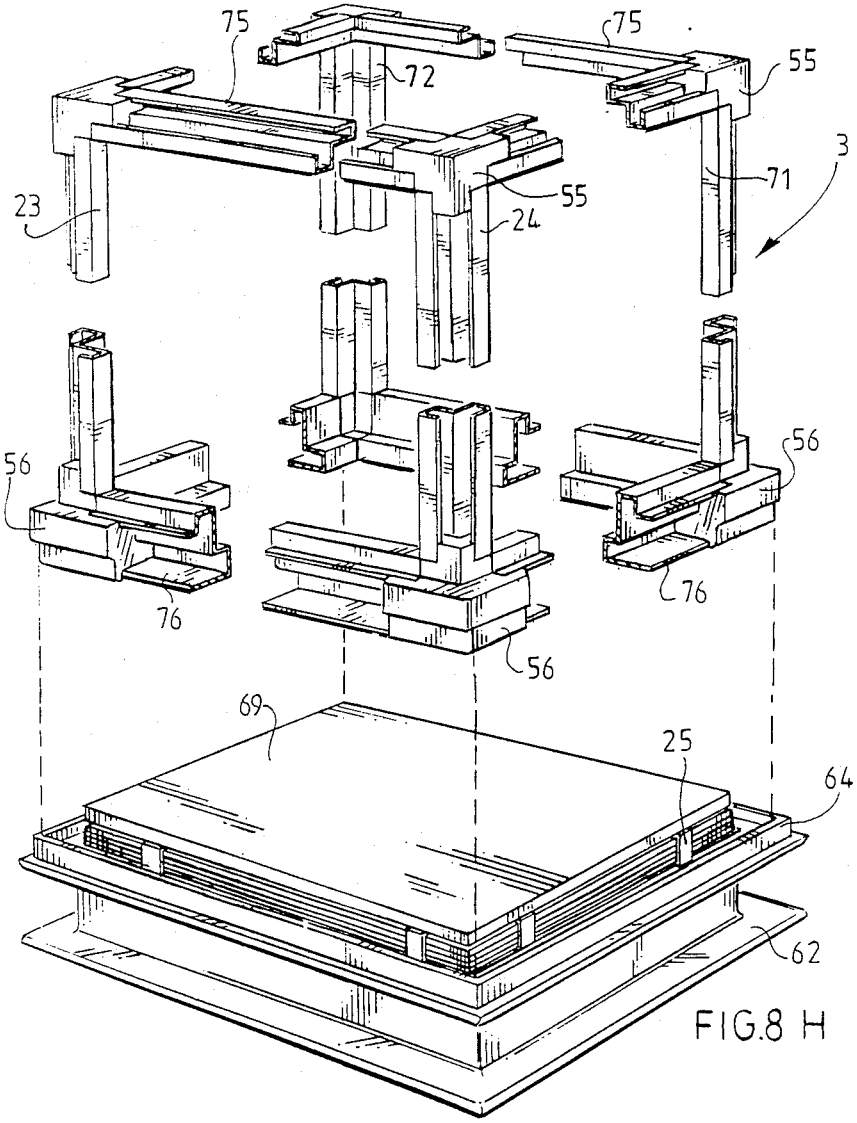
Figure 8I:
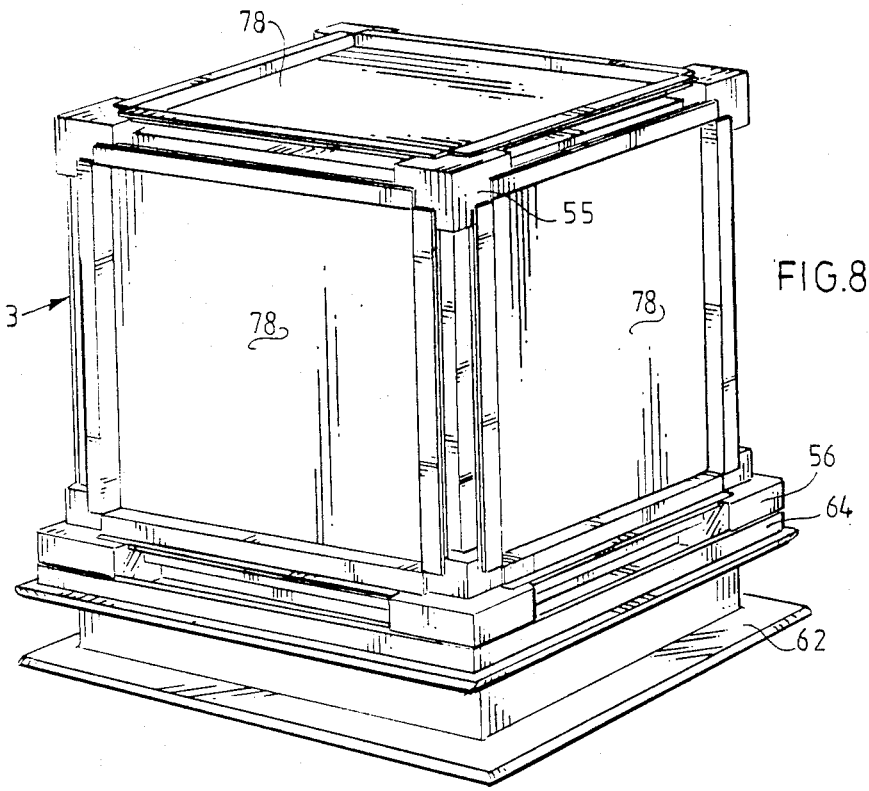
Figure 8J:
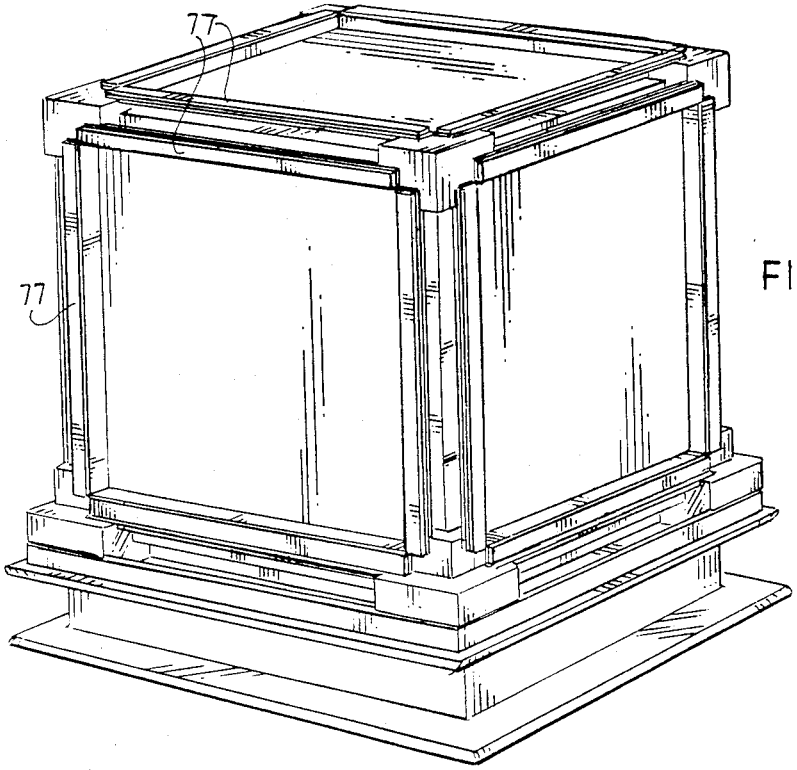
Figure 8K:
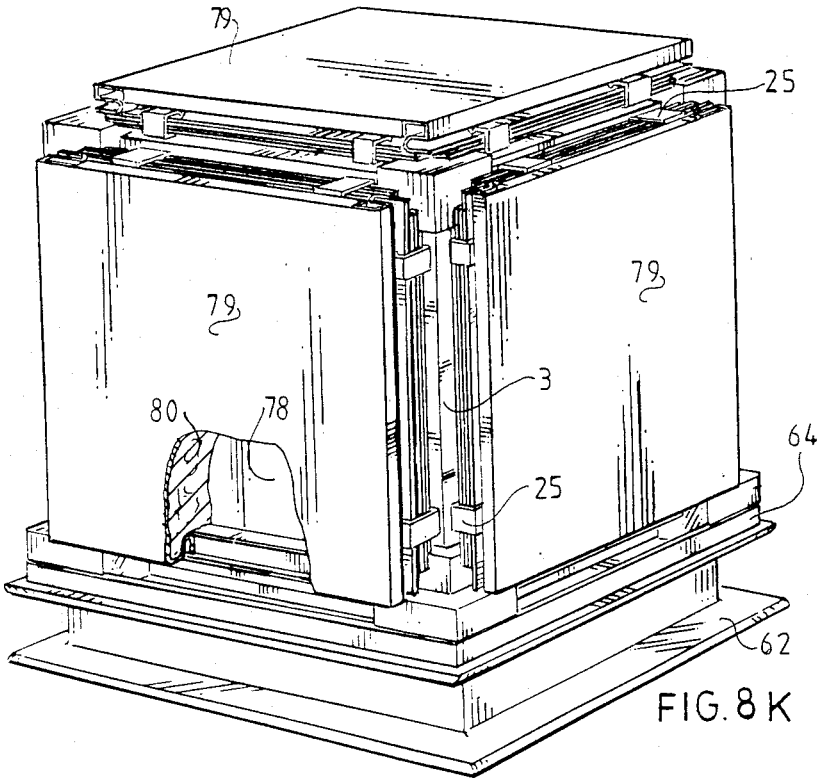
Figure 8L:
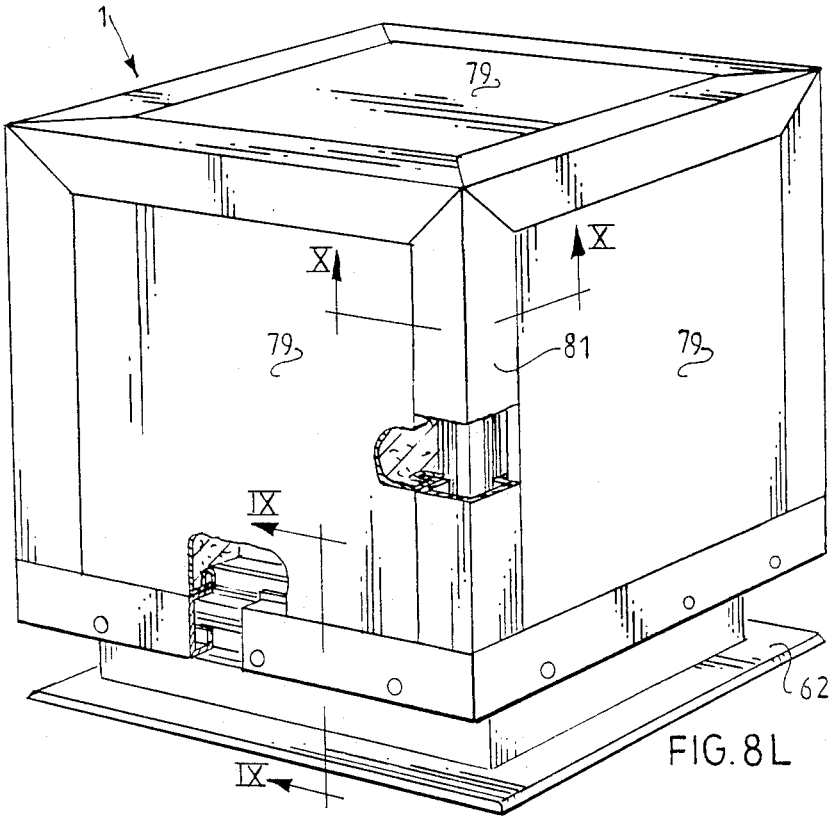

Further advantages, features and details of the current invention will become apparent with reference to a drawing, in which:

FIG. 1 shows an air conditioning cabinet which is constructed using a preferred embodiment of the system according to the invention for constructing same, FIG. 2 is a section along the line II—II from FIG. 1, FIG. 3 is an alternative embodiment of FIG. 2, FIG. 4A–4H show outer and inner panels for the construction system according to the invention, FIG. 5 shows detail V from FIG. 1, FIG. 6 shows detail VI from FIG. 1, FIG. 7 shows detail VII from FIG. 2 in perspective, FIG. 8A–8L show a preferred embodiment of the method for constructing an air conditioning cabinet making use of a preferred embodiment of the construction system according to the invention, FIG. 9 is a section along the line IX—IX from fig. 8L, FIG. 10 is a section along the line X—X from FIG. 8L, and FIG. 11 is the section from FIG. 3 in more detail.

An air conditioning cabinet 1 in double walled form (FIG. 1) which is constructed using a preferred embodiment of the method and the construction system according to the invention consists of a sub-frame 2, a frame 3 built up of rib profiles and having attached to it wall panels 4 which comprise outer panels 5. Air conditioning cabinet 1 is provided with an air inlet 6 and an air outlet 7 and contains for example a filter unit 8, a ventilator 9 and a cooling unit 10, but can also contain other air conditioning apparatus.

The outer panels 5, 30, 11 (FIG. 2) of the substantially horizontally arranged air conditioning cabinet are provided with edges 12, 13, 14 and 15 that are profiled and grip into one another such that these adjoining outer panels 5, 30, 11 can arranged from outside the frame 3 and that the edges 12, 13 and 14, 15 gripping into one another thereby form projections 16 and 17 respectively which can be attached to an inner panel 18, 19 and 20 that is present if required. In the air conditioning cabinet in double walled form from FIG. 2 the inner panels 18, 19 and 20 are indeed present. The edges 12, 13, 14 and 15 are located on the sides of the outer panels 5, 30, 11, whereby the edge on the one side 13, 15 has a substantially swan-neck form and on the other side 12, 14 is substantially Z-shaped. The outer initial panel 30 and the outer end panel 11 have in addition edges, 21 and 22 respectively, profiled such that they can be arranged from outside the frame 3 between rib profiles 23, 24 respectively and the adjoining outer panel 5, whereby the inner panels 18, 20 and the respective outer panel 11, 30 can be attached to the rib profiles 24 and 23 respectively using the same fastening means in the form of clamps 25. For this purpose the outer end panel 11 has a shortened edge end 26 of the swan-neck shaped edge 22 and the outer initial panel 30 has two swan-neck shaped edges 15, 21, whereby the edge end 27 of the swan-neck shaped edge 21 is likewise shortened.

By now sliding along each outer panel, whether or not provided with an associated inner panel, in sequence in the direction of the arrow A into the frame 3 built up of rib profiles 23, 24, the clamps 25 can in each case be arranged from outside the frame to be constructed in order to attach the outer and inner panels to each other and to the edge profiles.

In another embodiment (not shown), the inner panels are placed first, following which the outer panels are placed in the opposite direction.

The air conditioning cabinet 1 can in a simple manner be given a cold bridge free form, in the connections to the frame as well as in the mutual connections, using strips of insulation material 28 to be arranged between the edges.

Through the use of clamps 25 results an air conditioning cabinet which has a flat and evenly finished surface on the outside as well as the inside, which is of importance not only from an aesthetic viewpoint but also from the point of view of maintenance and cleaning, particularly in areas to be kept dust-free.

With the preferred embodiment of the construction system according to the invention air conditioning cabinets can of course be constructed in a simple manner in different lengths, by varying the number of outer intermediate panels 5. The height of the air conditioning cabinets to be constructed can be varied using the height of the panels. If required, it is conceivable to give air conditioning cabinets a vertical form, whereby the edges gripping each other will be located at the top and bottom of the panels.

In the remaining figures the same parts of the construction system will be referred to with the same reference numerals and, where not strictly necessary, these will not be discussed further for the sake of brevity.

FIG. 3 shows an alternative for the side wall of FIG. 2 of the air conditioning cabinet 1, whereby an outer access panel 31 and two associated inner access panels 32 are included. The inner initial panels 20 and the outer initial panels 30 are fitted from both rib profiles 23 and 24 respectively in a direction towards the centre, after which the inner and outer access panels 31, 32 are fitted between panels 20, 30. The outer access panel 31 is provided with an opening 34 closable with a cap 33, through which a screw bolt 35 can be reached, so that the inner access panels, each provided with two U-shaped side edges 36 and 37 and each being approximately half the length of the outer access panel 31 and which can be attached to each other using screw bolts 38 and a plate 39, become accessible, in order that the interior of air conditioning cabinet 1 can be reached in a simple manner.

The Z-shaped edges of the outer panels 5, 11 and 31 (FIG. 4A–4C) are provided with ends 40, 41, and 42 that are bent over for accurate gripping in the swan-neck shaped edge 13 of panel 5. In addition, the outer panels 5, 11, 31 and 30 (FIG. 4A–4C) are provided with substantially swan-neck shaped upper and lower edges 43 and 44 for attachment to horizontal rib profiles.

Vertical rib profiles 23, 24 as well as horizontal rib profiles are formed by corner profiles with two U-shaped edges.

In another embodiment of the construction system (not shown), the vertical rib profiles 23, 24 are provided with a double folded edge which serves to lock clamps. Insulating elements can be accommodated between the rib profiles and the clamps.

The inner panels 19, 18, 32 and 20 (FIG. 4E ∝ 4G) have Z-shaped upper and lower edges 45 and 46 for attachment to the horizontal rib profiles. The inner panel 19 is provided with a U-shaped side edge 47 as well as a Z-shaped edge 48. The inner end panel 18 is likewise provided on its side with a U-shaped edge 49 and a Z-shaped edge 50, but the length of this inner panel 18 is a piece a that corresponds with the length of a projection 16, 17, smaller than the inner panel 19. The inner initial panel 20 is provided with two Z-shaped edges 51 and 52. The inner access panel 32 is provided with two U-shaped edges 53, 54.

At the corners of the frame 3 (FIG. 5, 6) the air conditioning cabinet 1 is provided with upper corner elements 55 and lower corner elements 56, which are preferably manufactured from plastic and which are each provided with stops 57 and 58 respectively for gripping respective rib profiles.

The clamps 25 (FIG. 7) are preferably provided with a hook member 59 that is formed by part of the clamp 25 pressed along a centre line 60. The edges of the outer panels 5, 11 and 30 are preferably provided with recesses (not shown) for accommodating hook member 59, so that the clamp 25 is locked against shifting.

With respect to standardization of the air conditioning apparatus to be placed in the air conditioning cabinet, the width dimension of the inner and outer panels will usually be a multiple of a standard dimension, for example 32 cm. or a foot, while in height more variations of the dimensions of the inner and outer panels will be normal.

A preferred embodiment of a method for constructing an air conditioning cabinet will now be described (FIG. 8A–8L). A sub-frame 62 is first placed on the ground 61 (FIG. 8A). Using screw bolts 63 a framework 64 is then attached to sub-frame 62, whereby preferably a strip of insulation material 65 is accommodated between screw bolts 63 and framework 64 (FIG. 8B–8C). FIG. 9 also shows that the screw bolts 63 can also rest on the bottom profile 76 with a large ring, and can thus connect that bottom profile with the sub-frame, for example the screw bolts 63 can rest alternately on framework 64 and the bottom profile 76. Onto framework 64 is then laid a close-fitting base plate 66 (FIG. 8D). Onto the the edge of base plate 66 is subsequently laid a strip of insulation material 67, after which a layer of insulation material 68 is adhered to the whole base plate 66 and onto this layer is placed a bottom panel 69 (FIG. 8E–8F). Bottom panel 69 is provided with shortened swan-neck shaped edges 70 around which can be fixed clamps 25 for the attachment of bottom panel 69 to the framework 64 (FIG. 8G). Onto the bottom panel 69 and the framework 64 can now be placed, in the manner described above, a frame 3 which consists of vertical rib profiles 23, 24, 71 and 72, horizontal rib profiles 75 and bottom profiles 76. Located in the corners are the plastic bottom corner and top corner elements 55 and 56 already referred to. The rib profiles 23, 24, 71, 72 and 75 are formed by a corner profile having two U-shaped edges, while the bottom profile 76 consists of two corner profiles, one on top of the other, having a Z-shaped edge. The bottom profile can be provided with openings for accommodating screw bolts 63 (FIG. 8L) and it can also accommodate an insulating element.

In an air conditioning cabinet that is to take a double walled form inner panels 78 can now be attached to the constructed frame 3, whereby strips of insulation material 77 are arranged against their edges, following which outer panels 79 provided with swan-neck shaped edges can be attached to frame 3 using clamps 25. Accommodated between inner panels 78 and outer panels 79 is a layer of insulation material 80. Finally, over the edges of the thus constructed air conditioning cabinet 1 cover profiles 81 consisting of corner profiles having two edges Z-shaped in section are snapped into place into the free parts of the swan-neck shaped edges of the outer panels (FIG. 8L, FIG. 10). Accommodated between the cover profile 81 and the outer panels 79 are strips of insulation material 82, while located against the rib profiles is an insulating corner element 83. The horizontal cover profiles 84 are attached to the bottom profile 76 using a self-tapping screw 85 which can be reached via an opening 87 closable with a cap 86 (FIG. 8L, FIG. 9). Accommodated between the inner and outer panels are layers of insulation material 68, 80 and 90, 91 respectively (FIG. 9 and FIG. 10 respectively).

As will be apparent, FIG. 8A-8L show a preferred embodiment of the method and the construction system for an air conditioning cabinet provided with only one wall panel without intermediate panels, while it is precisely one of the advantages of the current invention that an air conditioning cabinet of a determined size can be constructed as required using a number of intermediate panels, depending on the air conditioning apparatus to be placed in it. This air conditioning apparatus is usually accommodated in frames of standard size, so that these frames can easily be placed in the frame of the air conditioning cabinet to be constructed that is also usually provided with standard measurements.

Finally, FIG. 11 further shows how access can be gained in a simple manner to the apparatus located behind the panels for the purpose of inspection. By removing the cap 32 the screw 35 can be reached, which is then unscrewed, following which the outer access panel 31 can be removed. After unscrewing screws 38 and removing the plate 39 and the clamp 25, inner access panels 32 can also be removed.

It is noted that it is possible with the construction system and the method according to the invention to build up air conditioning cabinets in single walled form, whereby, however, the clamps 25 then have to be replaced by other clamps having a smaller holding jaw or by screw connections.

It is to be understood that depending on requirements relating to moisture and temperature of the air to be conditioned as well as the air outside a cabinet, there will be chosen either a double or single walled air cabinet—the single walled of course being less expensive—, whether or not provided with a cold bridge free frame. As well inside as outside the cabinet the walls will have to remain dry to lengthen the lifetime of the cabinet. In case the conditioned air has to be dust free there will be chosen a double walled cabinet.

All the elements of the construction system can be manufactured with aid of a limited number of single mechanical devices.

We claim:

1. An air conditioning cabinet system comprising the combination of a subframe forming a supporting base for air conditioning components and an open, upstanding framework on the subframe, the upstanding framework comprising bottom rib profiles attached to the subframe in overlying, circumscribing relation thereto, vertically extending rib profiles attached to the bottom profiles at the corners of the subframe, and horizontally extending upper rib profiles joining the upper ends of the vertically extending rib profiles, each of the bottom rib profiles being of angled construction defining an open channel facing outwardly along a corresponding bottom side of the subframe, each of the vertically extending rib profiles being of angled construction defining mutually outwardly facing channels along the vertical sides of the framework, and each of the upper rib profiles being of angled construction defining mutually outwardly facing channels along the upper side edges of the framework, wall constructions received from outside the framework within the open spaces at the sides of the framework and lying in flush relation between the various rib profiles to expose the various channels defined thereby, clamp means around the peripheries of the wall constructions engaging over lips of the various channels and corresponding side edges of the wall constructions so as to be accessible due to the exposed channels, and cover profile means for covering the exposed channels and lying flush with the wall constructions to form a smooth exterior cabinet surface.

2. The method of constructing an air conditioning system which comprises the steps of:

(a) providing a substantially rectangular supporting base for air conditioning components;

(b) attaching a series of bottom rib profiles in circumscribing relation to the supporting base to define an outwardly facing channel along each side of the supporting base;

(c) attaching a vertically extending rib profile to the bottom rib profiles at each corner of the supporting base to define a pair of mutually outwardly facing vertical channels along each vertical rib profile;

(d) attaching horizontally extending rib profiles between upper ends of the vertical rib profiles and parallel with the bottom rib profiles to define mutually outwardly facing channels along each horizontally extending rib profile, the rib profiles defining an open rectangular cage framework; and (e) successively placing individual wall panels from the exterior of the open cage framework against the profiles in recessed and closing relation to the open cage framework to define wall panel channels adjacent the rib profile channels and engaging U-clamps within adjacent wall panel and rib profile channels and to clamp the wall panels to the rib profiles to hold them in place in such closing relation.

3. The method as defined in claim 2 wherein step (e) includes sliding the wall panels in their own planes into position t interengage adjacent, coplanar wall panels.

4. The method as defined in claim 3 including the step of placing cover profiles over the rib profiles to provide a smooth exterior surface for the system.

5. The method as defined in claim 2 wherein each wall panel includes an inner panel and an outer panel and including the step of engaging U-clamps over edges of successive inner and outer panels.

6. The method as defined in claim 5 including the step of placing cover profiles over the rib profiles to provide a smooth exterior surface for the system.

7. The method as defined in claim 4 wherein step (e) includes sliding the wall panels in their own planes into position to interengage adjacent, coplanar wall panels.

8. The method as defined in claim 7 including the step of placing cover profiles over the rib profiles to provide a smooth exterior surface for the system.

9. The method as defined in claim 4 wherein the inner panels are positioned first and the outer panels are positioned last.

10. The method as defined in claim 9 including the step of placing cover profiles over the rib profiles to provide a smooth exterior surface for the system.

11. The method as defined in claim 2 including the step of placing cover profiles over the rib profiles to provide a smooth exterior surface for the system.

12. An air conditioning system which comprises the combination of:

(a) a substantially rectangular supporting base for air conditioning components;

(b) a series of bottom rib profiles in circumscribing relation to the supporting base to define an outwardly facing channel along each side of the supporting base;

(c) a vertically extending rib profile attached to the bottom rib profiles at each corner of the supporting base to define a pair of mutually outwardly facing vertical channels along each vertical rib profile;

(d) horizontally extending rib profiles between upper ends of the vertical rib profiles and parallel with the bottom rib profiles to define mutually outwardly facing channels along each horizontally extending rib profile, the rib profiles defining an open rectangular cage framework;

(e) the individual wall panels engaging the open cage framework against the profiles in recessed and closing relation to the open cage framework to define wall panel channels adjacent the rib profile channels; and (f) U-clamps within adjacent wall panel and rib profile channels and to clamp the wall panels to the rib profiles to hold them in place in such closing relation.

13. An air conditioning system as defined in claim 12 wherein each wall panel includes an inner panel and an outer panel and further U-clamps over edges of successive inner and outer panels.

14. An air conditioning system as defined in claim 12 including corner elements joining the rib profiles to form the open rectangular cage framework.

15. An air conditioning system as defined in claim 14 including cover profiles over the rib profiles to provide a smooth exterior surface for the system.

* * * * *